United States Patent [19]

Yeager

[11] 4,266,770

[45] May 12, 1981

[54] BLACKJACK 21 COMPUTER

[76] Inventor: Charles A. Yeager, P.O. Box 181, Orangevale, Calif. 95662

[21] Appl. No.: 46,759

[22] Filed: Jun. 8, 1979

[51] Int. Cl.[3] ..... A63F 1/18

[52] U.S. Cl. ..... 273/148 R; 116/223; 116/DIG. 17; 116/312; 116/315; 235/120

[58] Field of Search ..... 273/148 R, DIG. 27; 116/223, 294, 297, 301, 312, 313, 315, 328, 329, DIG. 17; 235/88 G, 120, 121

[56] References Cited

U.S. PATENT DOCUMENTS

| | | | |
|---|---|---|---|
| 387,422 | 8/1888 | King | 235/120 |
| 592,927 | 11/1897 | Carson et al. | 235/121 |
| 618,099 | 1/1899 | Howland | 235/120 |
| 660,022 | 10/1900 | McCaskill | 116/315 |
| 1,460,842 | 7/1923 | Brooks | 235/121 |
| 1,465,086 | 8/1923 | Meacham | 116/124 R |
| 2,131,132 | 9/1938 | Alderman | 273/148 R |

OTHER PUBLICATIONS

Aids & Appliances, Jul. 1972–Jun. 1973, p. 19.

*Primary Examiner*—Anton O. Oechsle

*Attorney, Agent, or Firm*—Cushman, Darby & Cushman

[57] ABSTRACT

A hand held counter particularly adapted for counting cards during games of Blackjack. The counter includes two lever arms mounted for incremental rotation on a vertical axle in a cylindrical casing. The cylindrical casing includes a circular faceplate having two circularly arced slots. The lever arms are each spring mounted against notches in the cylindrical side wall of the casing and have positioning pins extending through a respective one of the slots. The lever arms may be incrementally rotated in an arc defined by the limits of the slot by using the thumb of the hand holding the counter to push the positioning pins. Position pins arrayed along the outer circumferences of the slots permit the user to tactilely identify the relative positions of the positioning pins of the levers and to thereby identify the counts being made. The counter may thereby be inconspicuously held and operated by one hand in a Blackjack player's lap while the player's eyes and his other hand are free to perform the other functions of the game.

9 Claims, 6 Drawing Figures

BLACKJACK 21 COMPUTER

The present invention relates to manual hand held counters and more particularly to a hand held counter which permits the user to make two independent counts and to tactilely determine each count without the need to look at the counter. The counter is particularly suited for counting cards during a game of Blackjack.

BACKGROUND OF THE INVENTION

"Blackjack" or "Twenty-one" is a popular gambling game played in casinos throughout the world. The game has increased in popularity in recent years. One cause of this increased popularity is the development of a number of playing strategies which, if accurately applied, actually give the user a statistical advantage over the casino's dealer, whose play is strictly regulated by casino rules.

A number of these strategies, which were developed with the use of a high speed general purpose computer by Julian H. Braun of the IBM Corporation and have been explained, modified and applied in a number of publications including "Playing Blackjack as a Business" by Lawrence Revere (Lyle Stewart, Inc., 1977 ed.), require that the player count cards. For example, in the Revere publication, there is described a "plus-minus" strategy whereby each of the cards numbered 2 through 6 are counted +1, Aces, 7's and 8's count zero and 10's, Jacks, Queens and Kings are counted −1. A "point count" strategy which requires a count of all cards in a manner similar to the "plus-minus" strategy and a separate count of Aces is also described. A continuous count is maintained until the dealer reshuffles the deck of cards. The count is utilized by the player in deciding when to take another card, when to stand, when to double the original bet and when to split the cards in his hand.

The strategies have been shown to work successfully so long as the player uses them accurately. However, using the strategies during an ongoing game of Blackjack can become confusing. Typically the player must keep track of the total count and/or the Ace count in his head while performing all of the other functions required to play the game and dealing with various distractions which commonly occur in casinos. Casino dealers often deal the cards very rapidly which makes it even more difficult for the player to maintain an accurate count in his head.

One solution to this problem of counting cards is to utilize a counter. Such a counter should be capable of inconspicuous use so that a count may be kept without attracting the attention of others. However, prior counters are not suitable for this purpose. Prior counters, whether electrically or mechanically operated, have visual displays only and therefore require the user to look at the counter in order to determine what the current count is. The use of such a counter could not be inconspicuous and would require the player's visual attention to be distracted from the playing cards, thereby interfering with his play. Furthermore, prior counters do not include means for making two counts simultaneously as is needed when certain playing strategies are being followed.

Accordingly, it is an object of the present invention to provide a counter which may be inconspicuously operated to maintain two separate counts without looking at the counter.

SUMMARY OF THE INVENTION

In accordance with the present invention, there is provided a hand held counter for counting points during a Blackjack game. The counter includes two levers (indicator arms) mounted for incremental rotation on a vertical axle in a cylindrical casing. The cylindrical casing includes a circular faceplate having two circularly arced slots. The indicator arms are each spring mounted against notches in the cylindrical side wall of the casing and have positioning pins extending through a respective one of the slots. The indicator arms may be incrementally rotated in an arc defined by the limits of the slot by using the thumb of the hand holding the counter to push the positioning pins. Position pins arrayed along the outer circumferences of the slots permit the user to tactilely identify the relative positions of the positioning pins of the levers and to thereby identify the counts being made. The counter may thereby be inconspicuously held and operated by one hand in a Blackjack player's lap while the player's eyes and his other hand are free to perform the other functions of the game.

DESCRIPTION OF THE DRAWINGS

Further objects, advantages and details of the present invention will be apparent from the following detailed description and accompanying drawings wherein.

DETAILED DESCRIPTION OF THE PREFERRED EMBODIMENT

Figure 1:
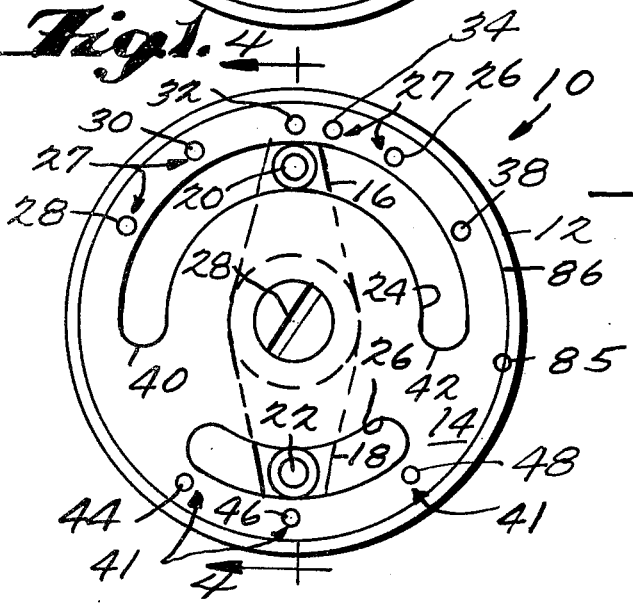
FIG. 1 is a plan view of the present invention with the indicator arms in a first position.
Figure 6:
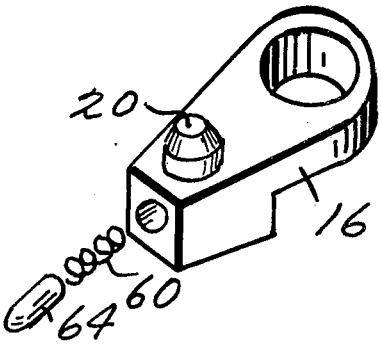
FIG. 6 is an exploded perspective view of one of the indicator arms shown in FIG. 5.

FIG. 1 is a plan view of an embodiment of a counter in accordance with the present invention, particularly suited for counting points and Aces while playing a game of Blackjack following the "plus-minus" strategy. The number of counting scales and the format of these scales are arbitrarily chosen for this purpose. It is contemplated that a greater or lesser number of scales and other scale formats may also be used for the "plus-minus" strategy of playing Blackjack, for other Blackjack strategies which rely on the counting of cards, and for other uses of a hand held counter where it is desirable to inconspicuously maintain one or more counts without looking at the counter.

Referring first to FIG. 1, there is shown a plan view of the counter 10 which includes a hollowed out cylindrical casing 12, a circular front faceplate 14 and indicator arms 16 and 18. Indicator arms 16 and 18 are rotatably mounted in casing 12 as will be described. Faceplate 14 is fixedly mounted to the interior top edge of casing 12. Positioning pins 20 and 22 are respectively fixedly mounted to the outer ends of indicator arms 16 and 18 so that they extend vertically through circularly arced slots 24 and 26 in faceplate 14. Slots 24 and 26 delimit separate angles of rotation of corresponding indicator arms 16 and 18 about center point 28. Positioning pins 20 and 22 are utilized as a point of leverage to rotate the indicator arms 16 and 18 and to provide tactile identification of the angular location of the respective indicator arms. The counter of the preferred embodiment would normally have a diameter and thickness comparable to that of a short stack of silver dollars so that it may be held comfortably in the fingers of one hand. The indicator arms 16 and 18 should be rotatable by thumbnail pressure applied to the positioning pins 24 and 26 by the thumb of the hand holding the counter. Tactilely identifiable linear scales 27 and 41 are respectively positioned adjacent to slots 20 and 22 so that the user may tactilely identify the location of the positioning pins 16 and 18, and thereby identify the counts represented by the relative positions of the pins 16 and 18 as will be described.

Figure 2:
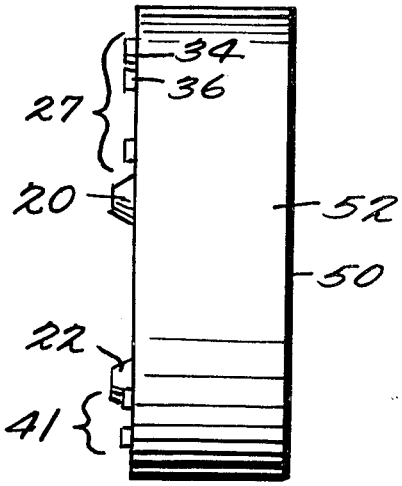
FIG. 2 is a side elevation of the present invention with the indicator arms in a second position.

When used in a Blackjack game, scale 27 would represent the "plus-minus" count and scale 41 would represent the Ace count. "Plus-minus" scale 27 includes position pins 28, 30, 32, 34, 36 and 38 fixed on faceplate 14 along the outer edge of slot 24 so that the user may tactilely identify the location of positioning pin 16. Pins 28, 30, 32, 34, 36 and 38 are respectively located to represent counts of −10, −5, 0, +2, +5 and +10 and the opposite ends 40 and 42 of slot 20 respectively represent counts of −15 and +15. Scale 41 includes position pins 44, 46 and 48 fixed on faceplate 14 along the outer edge of slot 26 so that the user may tactilely identify the location of positioning pin 18. Pins 44, 46 and 48 are respectively located to represent counts of 0, 4 and 8 Aces. As best illustrated in FIG. 2, the position pins of scales 27 and 41 extend upward from faceplate 14 sufficiently to be felt by the thumb in contact with positioning pins 24 and 26 but small enough not to interfere with the thumbnail movement of the positioning side pins.

Figure 4:
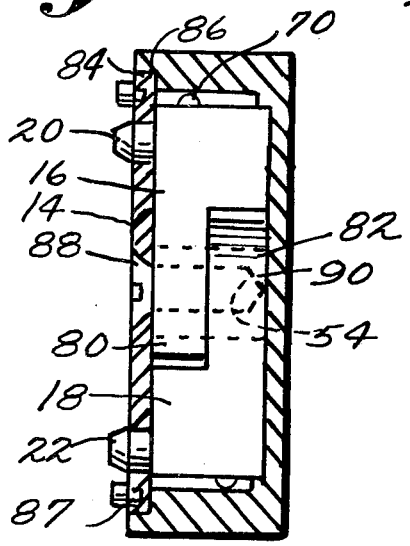
FIG. 4 is a side sectional elevation substantially along the line 4—4 in FIG. 1 showing the indicator arms of the present invention in elevation.
Figure 3:
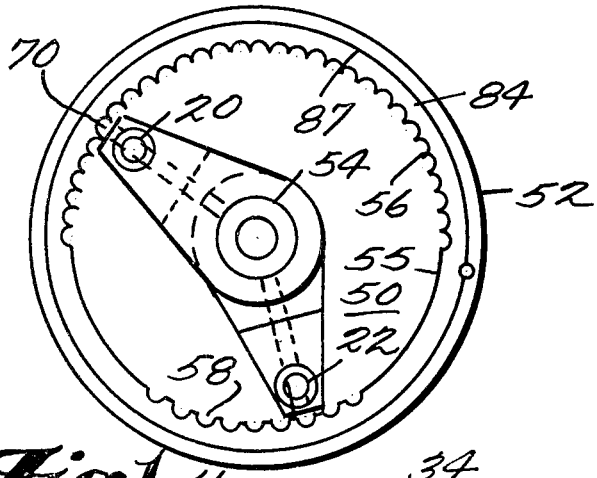
FIG. 3 is a plan view of the present invention with the indicator arms in the second position and with the top faceplate removed.
Figure 5:
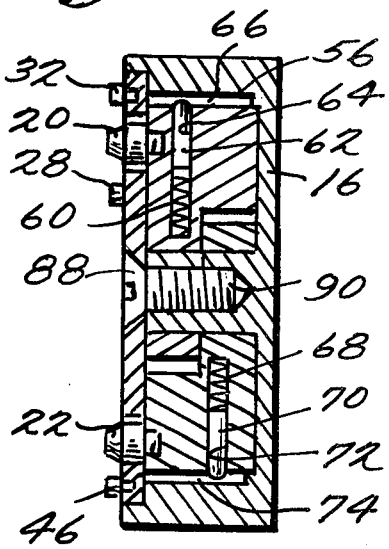
FIG. 5 is a second side sectional elevation of the present invention illustrating the inner workings of the indicator arms of the present invention.

Referring to FIGS. 3 and 4, casing 10 includes a circular base 50, cylindrical side wall 52 and an axle 54. The interior surface 55 of the side wall 52 has two sets of side-by-side notches 56 and 58 cut therein. Notches 56 are located adjacent to "plus-minus" scale 27 and slot 20, and represent individual counts of scale 27. Similarly, notches 58 are located adjacent to "Ace" scale 41 and slot 22 and represent the individual counts of scale 41. Indicator arms 16 and 18 are rotatably mounted to axle 54 and respectively extend radially outward to side surface notches 56 and 58. As is best illustrated in FIG. 5 each indicator arm includes a spring mechanism for releasably holding the indicator arm at a particular notch until the arm is rotated to an adjacent notch. Thus, an expansion spring 60 and a holding pin 62 are mounted in a radial recess hold 64 in tip 66 of indicator arm 16 so that spring 60 presses pin 62 into one of the notches 56. Similarly, expansion spring 68 and holding pin 70 are mounted in radial hole 72 in tip 74 of indicator arm 18 so that spring 68 pushes pin 70 into one of the notches 58. Notches 56 and 58 and indicator arm tips 66 and 74 have semicircular shaped surfaces such that side play of pins 62 and 70 is prevented and retraction of the pins will occur when an angular pressure is applied to indicator arms through positioning pins 24 and 26.

Referring now to FIG. 4, indicator arms 16 and 18 hinge portions 80 and 82 surround axle 54, with hinge portion 80 resting on top of hinge portion 82. Faceplate 14 rests in an inner circumferential recess 84 in the top of casing side wall 52 above indicator arms 16 and 18 and axle 54. A pin 85 is wedged between faceplate outer edge 86 and casing upper side wall inner edge 87 in order to fix faceplate 14 in a desired angular orientation. Faceplate 14 indicator arms 16 and 18 and casing 12 are held together by a screw 88 which passes through a center hole 89 in face-plate 14 and screws into a vertical threaded hole 90 in the center of axle 54.

The indicator arms 16 and 18 and the face-plate 14 are suitably composed of a hard aluminum for purposes of smooth and long-lasting operation. Casing 12 is suitably composed of a steel and is nickel plated to provide additional hardness. The size, shape and weight of the counter may be designed so that it will appear to a casual observer to be a stack of silver dollars rather than the counter which it is. In accordance with this design, the outer side surface of the casing 12 includes vertical and circumferential grooves similar to those of a stack of five silver dollars as is illustrated in FIG. 2. By making the weight of the counter equal to that of a stack of five silver dollars, the user would not be likely to make any unusual motions with the hand holding the counter.

In accordance with its suggested method of use, the counter 10 is placed in one hand resting on two center fingers with the first joint of the fingers in the center of the back of the counter. The counter 10 is held tight with the forefinger and middle finger of the same hand. The thumbnail may then be used to move either of the positioning pins 24 and 26 in their corresponding slots 20 and 22. In the game of Blackjack, the Ace indicator arm 18 and corresponding positioning pin 26 may be moved with the thumb or thumbnail through eight positions corresponding to the number of Aces which have been dealt from the same deck or decks of cards. To continue counting beyond eight, if more than two decks are used, the arm may be moved from one end to the other of the slit after the count of eight Aces. If the strategy being utilized involves the counting of a card other than Aces, e.g., 5's, the Ace positioning pin may of course be utilized for that purpose instead. Plus-minus indicator arm 16 may also be moved with the thumbnail and would ordinarily be moved one notch 56 to the left when a negative count is made and one notch 56 to the right when a positive count is made.

While the invention has been herein shown and described in what is presently conceived to be the most practical and preferred embodiment, it will be apparent to one of ordinary skill in the art that many modifications may be made thereof within the scope of the invention. For example, while the particular embodiment described in detail herein is particularly designed for counting cards in accordance with certain strategies utilized in games of Blackjack, it is contemplated that other uses may be made of the counter of the present invention. In this regard it will be appreciated that in any application where it is desirable to count digits with a hand-held counter and to be able to tactilely identify and adjust the count without looking at the counter, the present invention may be very useful. It is also recognized that the particular number of counts to be made on the counter and the number of possible counting states for each count, as well as the number and location of positioning pins or the like, may be varied in accordance with the particular application. All such modifications are fully contemplated by the present invention as recited in the following claims.

What is claimed is:

1. A hand held counter for making two counts of cards during a game of Blackjack, comprising:

a cylindrical frame closed at one end, open at the opposite end, and having a longitudinal axis and a circularly arcuate vertical inner side surface;

an axle fixed to said frame along said axis; a horizontal face plate disposed on said frame at said open end having first and second circularly arched slots at least partially surrounding said axis and corresponding first and second nonoverlapping scales circularly arched about said axis, said scales including tactilely identifiables indicia in the form of protrusions from the horizontal plane of said face plate adjacent said first and second slots corresponding to positive and negative counts; and means for tactilely adjusting and identifying said two counts, including first and second horizontal indicator arms rotatably mounted to said axle beneath said plate and first and second positioning pins respectively mounted to said first and second indicator arms and respectively vertically extending into said first and second slots, said protrusions being disposed in horizontally spaced physical relation to all of said pins respectively radially outside said first and second slots so that said two counts may be tactilely identified by the spacial relation to said pins and said protrusions.

2. A hand held counter for making two counts of cards during a game of Blackjack, comprising:

a cylindrical frame having vertical cylindrical inner and outer side surfaces, closed at one end and open at the opposite end, and having a longitudinal axis;

an axle fixed to said frame along said axis;

a horizontal face plate disposed on said frame at said open end having first and second circularly arched slots partially surrounding said axis and corresponding first and second nonoverlapping scales circularly arched about said axis, said scales including tactilely identifiable indicia in the form of discontinuities in the horizontal plane of said face plates adjacent said first and second slots corresponding to positive and negative counts; and means for tactilely adjusting and identifying said two counts, including first and second horizontal indicator arms rotatably mounted to said axle beneath said plate and first and second positioning pins respectively rigidly fixed to said first and second arms, respectively vertically extending into said first and second slots, said discontinuities being disposed in horizontally spaced physical relation to all of said pins so that said two counts may be tactilely identified by the spacial relation of said pins and said discontinuities;

said first and second indicator arms each having a horizontally spring mounted extendable end portion which abuts said inner side surface;

said first and second arms extending radially between said axle and said inner side surface, said inner side surface having a plurality of side-by-side vertical grooves for removably retaining said first and second indicator arm end portions therein, each of said grooves corresponding to a single count, each of said first and second indicator arms being movable between adjacent ones of said grooves by the application to its pin of a force directed horizontally perpendicular to the radial length of said each arm.

3. A hand held counter for making two counts of cards during a game of Blackjack, comprising:

a cylindrical frame having vertical cylindrical inner and outer side surfaces, closed at one end and open at the opposite end, and having a longitudinal axis, said frame outer side surface having the dimensions, vertical and circumferential grooves and feel of a stack of a number of silver dollars;

an axle fixed to said frame along said axis;

a horizontal face plate disposed on said frame at said open end, having first and second circularly arched slots partially surrounding said axis and corresponding first and second nonoverlapping scales circularly arched about said axis, said scales including tactilely identifiable indicia in the form of protrusions from the horizontal plane of said face plate adjacent said first and second slots corresponding to positive and negative counts; and means for tactilely adjusting and identifying said two counts including first and second horizontal indicator arms rotatably mounted to said axle beneath said plate and first and second positioning pins respectively mounted to said first and second arms and respectively vertically extending into said first and second slots, said protrusions being disposed in horizontally spaced physical relation to said pins so that said two counts may be tactilely identified by the physical relation of said pins and said protrusions;

the total weight of the counter being equal to that of a stack of said number of silver dollars;

said first and second counter arms each including means, abutting said inner side surface, for removably retaining said first and second counter arms in any one of a plurality of angular positions between said axle and said inner side surface, said inner side surface having a plurality of side-by-side vertical grooves defining said plurality of angular positions, each of said angular positions corresponding to a single count.

4. A hand held counter for making two counts of cards during a game of Blackjack, comprising:

a cylindrical frame, closed at one end, open at the opposite end, and having a longitudinal axis and a circularly arcuate vertical inner side surface;

an axle fixed to said frame along said axis;

a horizontal face plate disposed on said frame at said open end having first and second circularly arched slots at least partially surrounding said axis and corresponding first and second nonoverlapping scales circularly arched about said axis, said scales including tactilely identifiables indicia in the form of protrusions from the horizontal plane of said face plate adjacent said first and second slots corresponding to positive and negative counts; and means for tactilely adjusting and identifying said two counts, including first and second horizontal indicator arms rotatably mounted to said axle beneath said plate and first and second positioning pins respectively mounted to said first and second indicator means and respectively vertically extending into said first and second slots; said protrusions being disposed in horizontally spaced physical relation to respective ones of said pins respectively radially outside said first and second arched slots so that said two counts may be tactilely identified by the spacial relation of said pins and protrusions;

said first and second arms being spring mounted between said axle and inner side surface, said inner side surface having a plurality of side-by-side vertical grooves for removably retaining said first and second counter arm end portion therein, each of said grooves corresponding to a single count, each of said first and second indicator arms being movable between adjacent ones of said grooves by the application to its pin of a force applied thereto by the thumb of the hand holding said counter.

5. A hand held counter for making two counts of cards during a game of Blackjack, comprising:

a cylindrical frame having vertical cylindrical inner and outer side surfaces, closed at one end and open at the opposite end, and having a longitudinal axis, said frame outer side surface having the dimensions, grooves and feel of a stack of a number of silver dollars;

an axle fixed to said frame along said axis;

a horizontal face plate disposed on said frame at said open end having first and second circularly arched slots partially surrounding said axis and corresponding first and second nonoverlapping scales circularly arched about said axis, said scales including tactilely identifiable indicia in the form of protrusions from the horizontal plane of said face plate adjacent said first and second slots corresponding to positive and negative counts; and means for tactilely adjusting and identifying said two counts including first and second horizontally extending indicator arms rotatably mounted to said axle beneath said plate and first and second positioning pins respectively rigidly fixed to said first and second arms, respectively vertically extending into said first and second slots, said protrusions being disposed in horizontally spaced physical relation to all of said pins so that said two counts may be tactilely identified by the special relation of said pins and said protrusions;

the total weight of the counter being equal to that of a stack of said number of silver dollars;

said first and second counter arms each having a horizontally spring mounted radially extendable end portion which abuts said inner side surface;

said first and second counter arms extending radially between said axle and said inner side surface, said inner side surface having a plurality of side-by-side vertical grooves for removably retaining said first and second counter arm end portions therein, each of said grooves corresponding to a single count, each of said first and second counter arms being movable between adjacent ones of said grooves by the application to its pin of a force applied thereto by the thumb of the hand holding said counter directed horizontally perpendicular to the radial length of said each counter arm.

6. A hand held counter as in claim 1 or claim 3 wherein said first scale comprises a scale for recording 31 counting units and said second scale comprises a scale for recording nine counting units.

7. A hand held counter as in claim 2 or claim 3 wherein said frame includes a unitary base and side portion said face plate being mounted to the top of said side portion, said base consisting substantially of steel; said indicator arms and top element consisting substantially of aluminum.

8. A counter as in claim 2 or claim 4 or claim 5 wherein said inner surface vertical grooves are rounded.

9. A counter as in claim 5 wherein said axle is formed integrally with the closed end of said frame, said axle having an axially aligned screw hole formed therein opening at the top thereof, said face plate having an axially aligned center hole therein, said counter further comprising a screw insertable through said center hole into said screw hole to fasten said face plate to said frame at the open end thereof.

* * * * *